US006684931B2

(12) United States Patent
Reimer et al.

(10) Patent No.: US 6,684,931 B2
(45) Date of Patent: Feb. 3, 2004

(54) COUNTER WEIGHT DOOR

(75) Inventors: Greg Reimer, Steinbach (CA); Abram H. Enns, Mitchell (CA); Dennis Braun, Pansy (CA); Richard Klassen, Steinbach (CA); Walter Toews, Kleefeld (CA); Len Neufeld, Steinbach (CA)

(73) Assignee: Hanover Door Systems (1966) Inc., Manitoba (CA)

( * ) Notice: Subject to any disclaimer, the term of this patent is extended or adjusted under 35 U.S.C. 154(b) by 0 days.

(21) Appl. No.: 09/788,625

(22) Filed: Feb. 5, 2001

(65) Prior Publication Data

US 2002/0104624 A1 Aug. 8, 2002

(51) Int. Cl.[7] ..... E05F 11/00; E05D 15/06

(52) U.S. Cl. ..... 160/190; 160/201; 49/200

(58) Field of Search ..... 160/190, 193, 160/201; 16/197, 198, DIG. 7, DIG. 1; 49/200, 199, 201, 202; 242/388.1, 388.5; 52/71, 29

(56) References Cited

U.S. PATENT DOCUMENTS 1,077,924 A * 11/1913 Atlas ..... 16/218
2,033,893 A * 3/1936 White ..... 160/201 X
2,239,462 A * 4/1941 Morgan ..... 160/190
2,320,604 A * 6/1943 Jackson et al. ..... 160/190 X
3,756,585 A * 9/1973 Mihalcheon ..... 160/193 X
3,981,343 A * 9/1976 De Vito ..... 160/190 X
4,887,658 A * 12/1989 Cloutier ..... 160/190
5,222,541 A * 6/1993 Hornberger ..... 160/190 X
5,259,433 A * 11/1993 Cloutier ..... 160/190
5,301,732 A * 4/1994 Aabel ..... 160/193 X
5,482,103 A * 1/1996 Burgess et al. ..... 160/190 X
5,558,147 A * 9/1996 Nofziger ..... 160/190
5,865,235 A * 2/1999 Krupke et al. ..... 160/191

FOREIGN PATENT DOCUMENTS

ES PCT/ES95/00115 * 4/1996 ..... 160/201 X

* cited by examiner

*Primary Examiner*—Hugh B. Thompson
(74) *Attorney, Agent, or Firm*—Adrian D. Battison; Michael R. Williams; Ryan W. Dupuis

(57) ABSTRACT

A counter weight door has a plurality of counter weights each associated with a respective one of the panels and an interconnecting spring connecting each of the weights to the next. At least one of the counter weights has a cradle which is arranged to receive a plurality of weighted members. The spring arrangement connecting one counter to the next is housed within the cradle and includes a shaft on which the spring is mounted. The door has a pulley system which has a first pulley on one side of the door, a second double pulley on the other side of the door, a first cable fixed at a first end to the door extending through the first pulley and a second cable fixed at a first end to the door extending through the second pulley to the counter weight system.

8 Claims, 9 Drawing Sheets

COUNTER WEIGHT DOOR

FIELD OF THE INVENTION

The present invention relates to an improved counter weight door.

BACKGROUND

Counter weighted overhead doors are well known and components for these doors are commercially available in many standard sizes. However when providing an counter weight overhead door for a large opening a number of problems arise. One of these problems is that conventional door components are designed for doors up to a certain size. These components and are not robust enough to handle the additional weight and forces required for a door covering a large opening. This requires that custom fittings and components be designed for individual doors which have openings which are too large to accommodated by standard sized components.

A second problem of overhead counter weight doors is that fixing and aligning the pulleys which guide the cables that are used to open and close the door is difficult since the pulleys are fixed to the wall of the building making positioning of the pulleys imprecise. Furthermore this often requires reinforcing a portion of the building to accept mounting brackets and fasteners to support the pulleys.

SUMMARY

According to the present invention there is provided an improved counter weight door comprising:

- a guide means arranged to be located on respective sides of an opening on a building;
- a door which is arranged to be supported on respective side thereon by the guide means, the door having a plurality of panels each connected to the next one of the panels for common movement vertically in the guide means;
- a counter weight system coupled to the door for providing counter weight for the weight of the door, the counter weight system having a plurality of counter weights each associated with a respective one of the panels;
- an interconnecting means connecting each of the weights to the next;
- the counter weight system having means for adjusting the weight of at least one of the counter weights;
- wherein the counter weights having a support means which is arranged to receive a plurality of weighted members.

Conveniently the means for adjusting the weight having a changeable counter weight member which provides an appropriate weight for the counter weight such that the weight is relative each respective panel and door type.

Preferably each counter weight has a housing having a substantially flat bottom surface, side walls extending vertically from respective ends of the bottom surface, the bottom surface provides the support for the plurality of weighted members.

Preferably the counter weights are arranged to be stacked one on top of the next when the door is fully opened and spaced apart vertically when the door is fully closed.

According to another aspect of the present invention the interconnecting means provides a spring arrangement connecting one counter to the next.

Conveniently the spring arrangement is located with an enclosure within the counter weight.

Preferably the spring arrangement has a shaft located within a centre enclosure of the counter weight, the shaft being vertically orientated and has a horizontal flange at the top end within the enclosure, a spring surrounds the shaft and engages the flange and a bottom surface of the counter weight such that the spring forces the shaft upwards.

Conveniently an elongate member is coupled to a bottom end of the shaft and extends downwards therefrom to a respective counter weight below.

According to another aspect of the door there is provided a pulley system having;

- a first pulley mounted adjacent a first side of the door;
- a second guide pulley mounted adjacent the second side of the door;
- a first elongate member fixed at a first end to the door extending through the first pulley;
- a second elongate member fixed at a first end to the door extending through the second pulley;
- wherein the second pulley arrangement has two pulleys in a fixed rotatable relationship for receiving the first and second elongate members, the elongate members extend through a third pulley at the counter weight system and are anchored at a second end.

An advantage of the present invention is provided by a driveable member on the second pulley which is arranged to be driven by a motor such that the door is raised and lowered using a motor.

Preferably the driveable member is a sprocket arranged to receive a chain from the motor.

An advantage of the present invention is that the door can be completely produced in a factory and simply assembled on site.

BRIEF DESCRIPTION OF THE DRAWINGS

In the accompanying drawings, which illustrate an exemplary embodiment of the present invention.

DETAILED DESCRIPTION

Figure 1:
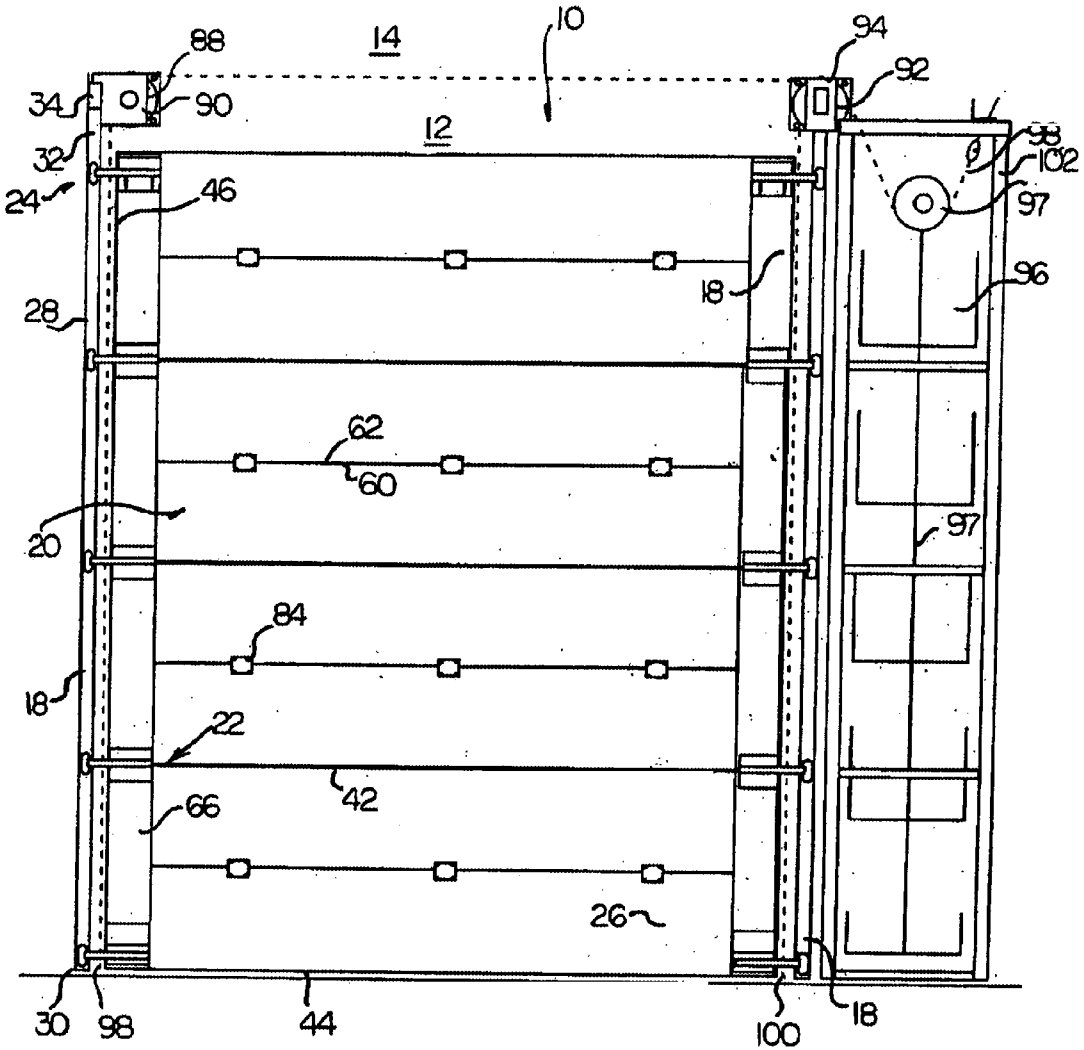
FIG. 1 is a front elevational view of the counter weight door.

Referring to the accompanying drawings, there is illustrated an improved counter weight door is shown generally at 10. The improved counter weight door 10 is for use of an opening 12 in the wall 14 of a building. The improved counter weight door 10 comprises a pair of spaced apart guide rail members 18, a plurality of door panels 20, a plurality of pivot connection 22, and a plurality of guide rail followers 24.

Figure 10:
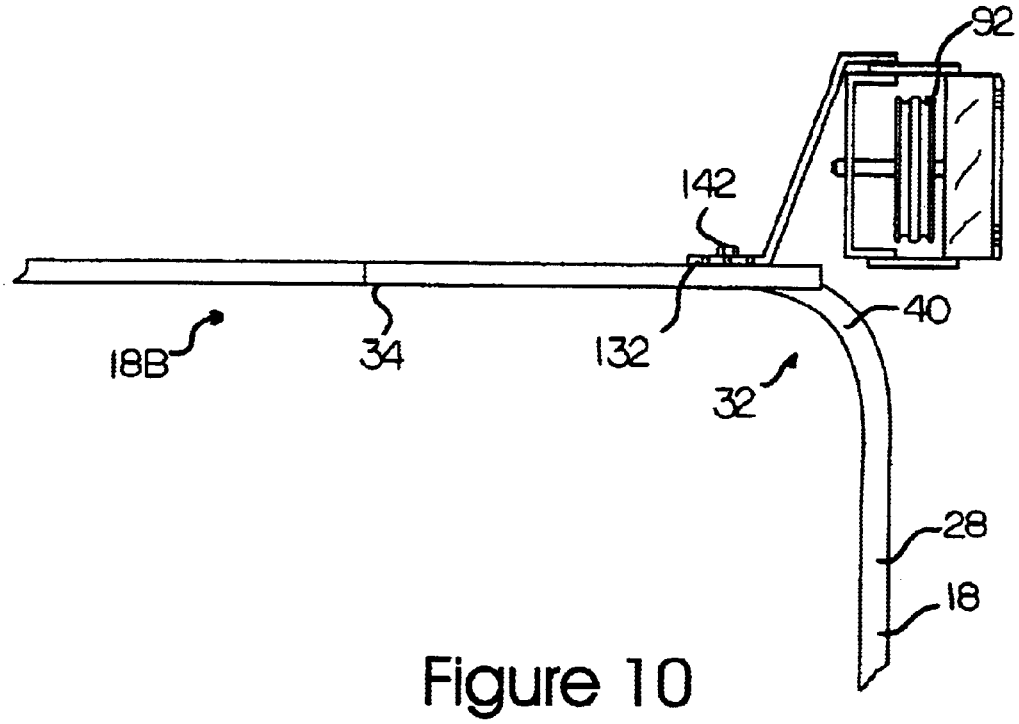
FIG. 10 is a side view of the second part of the pulley system mounted on the counter weight door.
Figure 11:
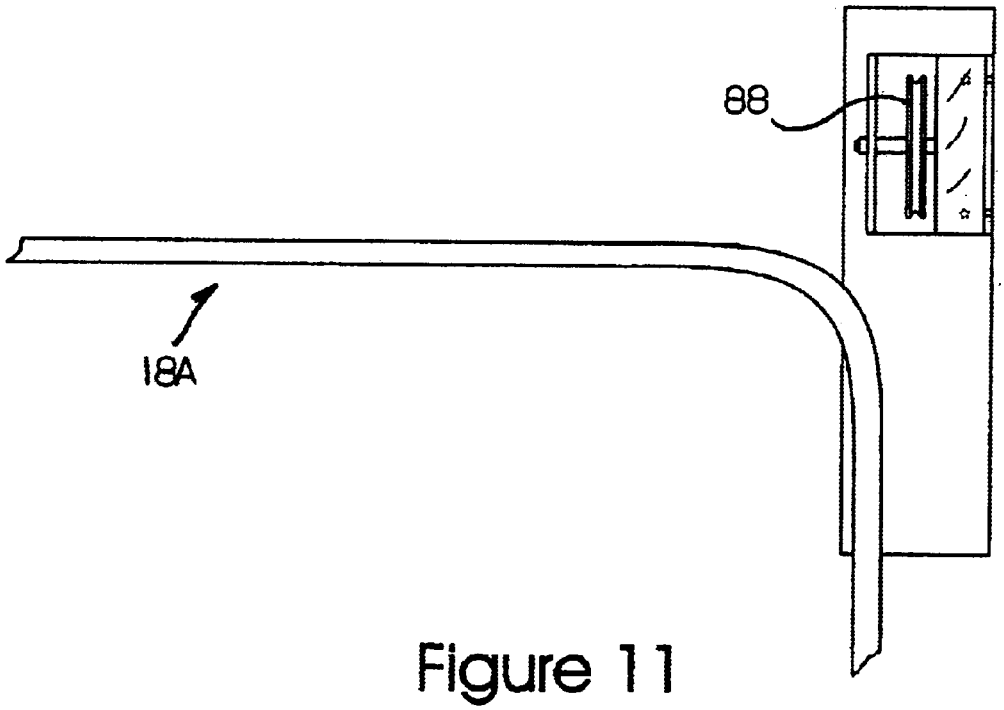
FIG. 11 is a bottom view of FIG. 6.

Referring to FIGS. 1, 10 and 11 the pair of spaced apart guide rail members 18 are arranged with one on each side of the opening 12 in the wall 14. Each one of the pair of rail members 18 includes a substantially vertical portion 28 which extends upwards from a bottom end 30 to a top end 32 and which is fixed to the wall 14 adjacent sides of the opening. A substantially horizontal portion 34 is arranged adjacent the top end 32 of the substantially vertical portion 28 and extends rearwards into the building from a front end 36 to a rear end 38. A curved portion 40 extends upwardly and rearwardly between the top end 32 of the substantially vertical portion 28 and the front end 36 of the substantially horizontal portion 34.

The plurality of door panels 20 each extend from a top end 42 to a bottom end 44 and from a first side 46 adjacent a first one of the pair of rail members 18*a* to a second side 48 adjacent a second one of the pair of rail members 18*b*. The plurality of door panels 20 are arranged in end to end alignment with the top and bottom edges 42 and 44 of adjacent door panels 20 adjacent one another.

The plurality of pivot connections 22 are arranged to pivotally connect each one of the plurality of door panels 20 to the door panels lying adjacent. Each one of the plurality of pivot connection 22 is pivotal about an axis of rotation 50 extending substantially perpendicular to and between the rail members 18*a* and 18*b*.

The plurality of guide rail followers 24 comprise a guide roller for engaging a respective one of the spaced apart guide members 18 and an axle member 54 for rotatably mounting the guide roller 52 at the pivot connection 22.

In order to accommodate the additional weight of a large counter weight door 10 the arrangement of the pivot connections 22 and the guide rail followers 24 has been modified. A pair of pivot connections 22 comprises a pair of hinge members 56 mounted side by side at the joint between adjacent top and bottom edges 42 and 44 of adjacent ones of the plurality of door panels 20. The hinge members 56 include axle supporting means aligned with each other to receive the axle member 54 of a respective one of the guide rail followers 24 therethrough. The axle supporting means comprises an elongate tubular member 58 mounted on the hinge member 56 arranged to extend substantially parallel to an axis of rotation extending substantially perpendicular to and between the rail members 18. The axle 54 of the guide rail follower 24 has been lengthened to allow it to extend through both of the elongate tubular members 58 of the paired pivot connectors 22. This gives each pivot connection 22 additional strength and yet allows standard hinged members to be used thereby keeping costs down and allowing a door manufacturer or installer to stock fewer types of hinge.

Figure 4:
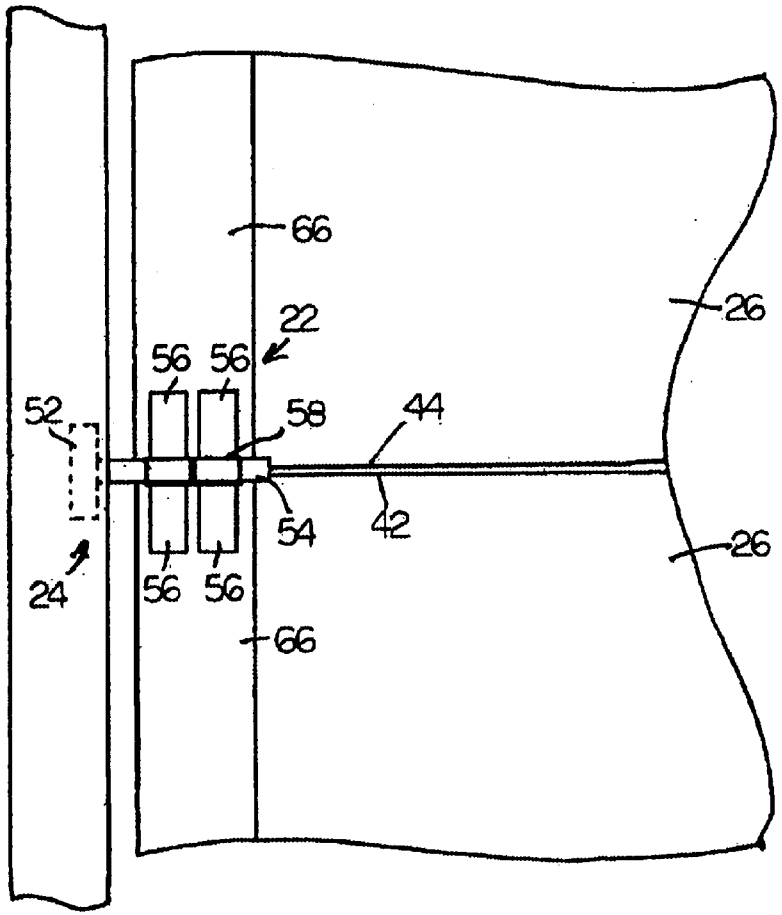
FIG. 4 is an enlarged view of a part of the door.
Figure 4A:
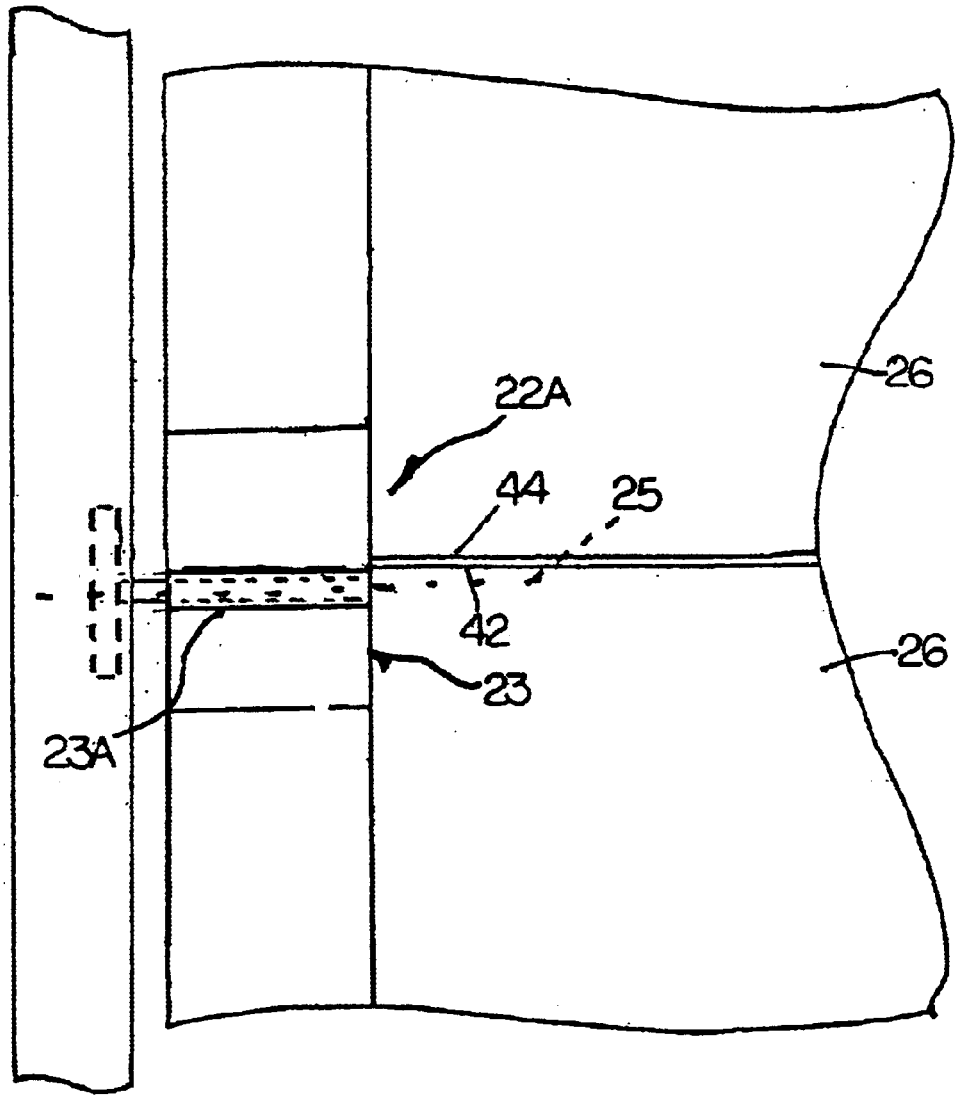
FIG. 4A is an enlarged view of an alternative part of the door.

FIG. 4A shows an alternative arrangement of the pivot connectors 22A. The alternate pivot connector comprises a hinged plate 23 which connects the adjacent door panels. The plate has a hinge 23A which has a horizontal axis 25 that is located below the adjacent edges of the panels.

Each one of the door panels 20 comprises a plurality of door panel sections 26 each of which includes a top edge 60 and a bottom edge 62 and extends from the first side 46 of the door panel 20 to the second side 48 of the door panel 20. Each door panel section is arranged in end to end alignment like the door panels 20 with the top and bottom edges 60 and 62 of adjacent door panel sections 26 lying adjacent one another.

The door panels 20 comprise two or more standard sized overhead door panel sections 26 which are joined together by a pair of J-shaped channel members 66 one being arranged along each of the first and second sides 46 and 48 of the respective door panel 20. Using standard sized door sections allows the door manufacturer or installer to build custom sized door panels 20 from standard sized components thereby reducing costs and reducing the required number of different parts.

The J-shaped channel members 66 are arranged to hold the plurality of door panel sections 26 in alignment relative to each other such that each of the door panel sections 26 is supported vertically by the J-channel 66 when the door 10 is in a fully closed position.

Each one of the pair of J-shaped channel members 66 comprises a leg member 68 extending from a first end 70 to a second end 72, the foot member 76 arranged at the second end 72 of the leg member 70. The foot member 76 includes a first portion 78 extending perpendicular from the leg member 70 and an end portion 80 extending from an outer end 82 of the first portion 78. A bottom plate 82 extends perpendicular to the leg member 70 and the foot member 76 and is fixed thereto.

Each one of the pair of J-shaped channel members 66 is arranged at a respective one of the first and second sides of the door panel 20, and is arranged such that the plurality of door panel sections 26 is supported vertically by the bottom plate 82 when the door 10 is in the fully closed position, and such that the plurality of door panel sections 26 are held in alignment relative to each other by the leg and foot members 70 and 76 of the J-shaped panel 66.

Each door panel 20 includes fixing means 84 for fixing the top and bottom edges 60 and 62 of adjacent ones of the plurality of door panel sections 26 to one another. The fixing means comprise a plurality of plate or hinge members arranged to extend across the joint between adjacent door panel sections 26 and fasteners for fastening the hinge or plate members in place. The plurality of fixing means 84 are spaced apart across the door panel 20 between the first side 46 and the second side 48.

Figure 8:
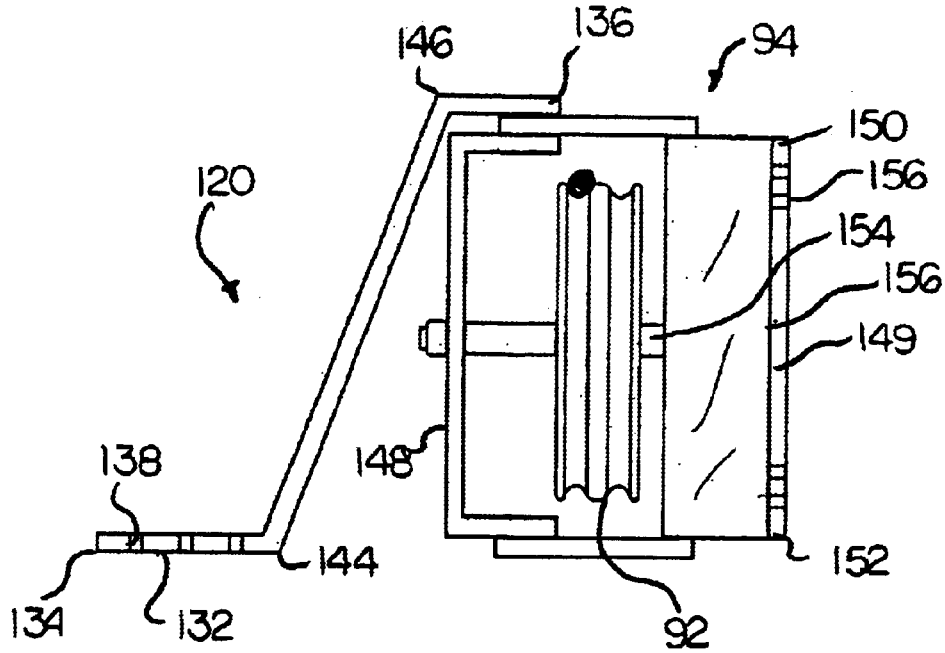
FIG. 8 is a side view of a second part of the pulley system.
Figure 8A:
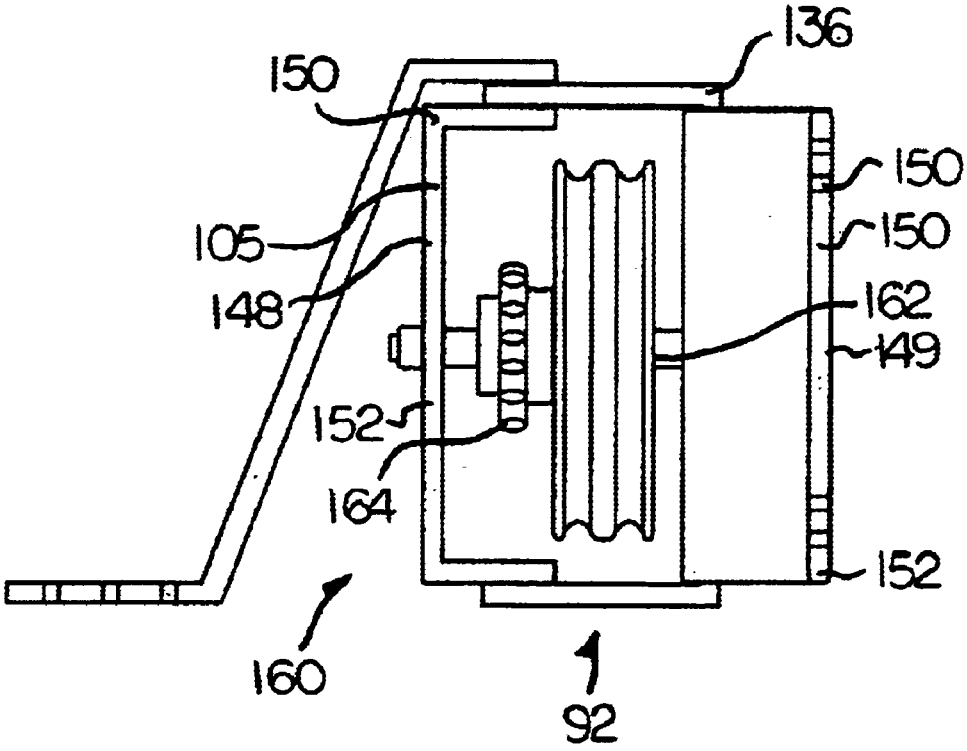
FIG. 8A is a side view of an alternate second part of the pulley system.

As best shown in FIG. 8A, an alternative arrangement of the pulley 160 is illustrated. The alternate arrangement is arranged to allow a motor to provide open and closing movement to the door. The pulleys are fixed together on a shaft 162 in which the pulley is able to rotate thereon. A sprocket 164 is fixed to the pulleys such that a chain can be situated around the sprocket and can be driven by the motor opening and closing the door.

Figure 2:
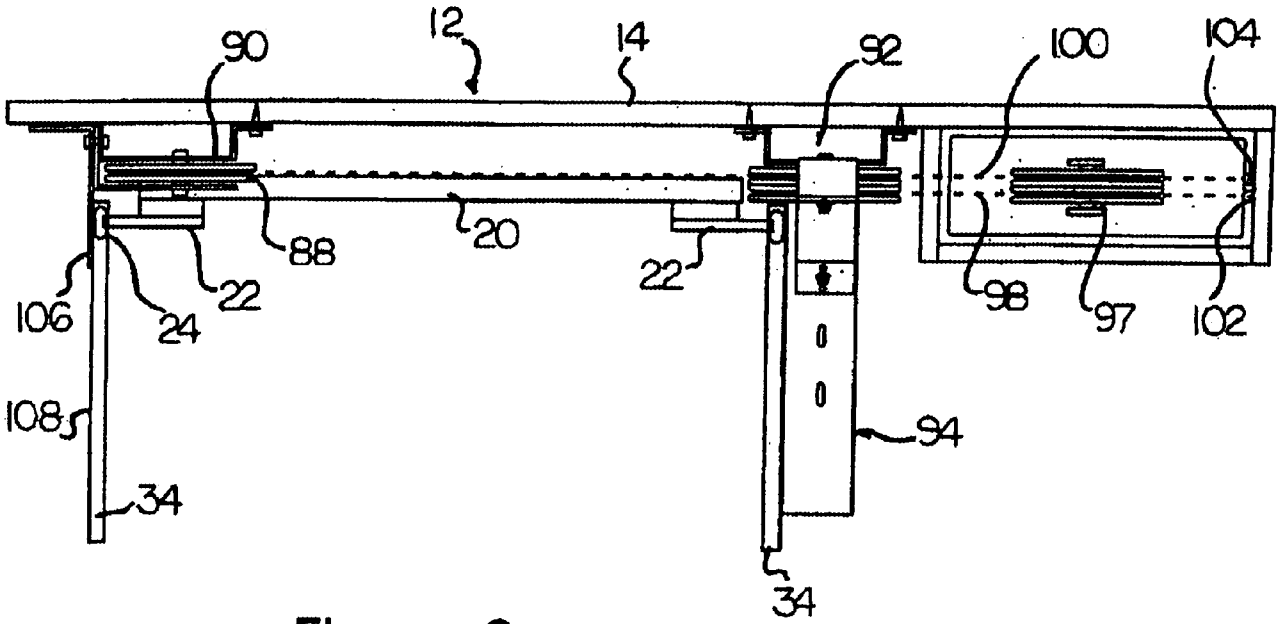
FIG. 2 is a top view of the counter weight door.
Figure 3:
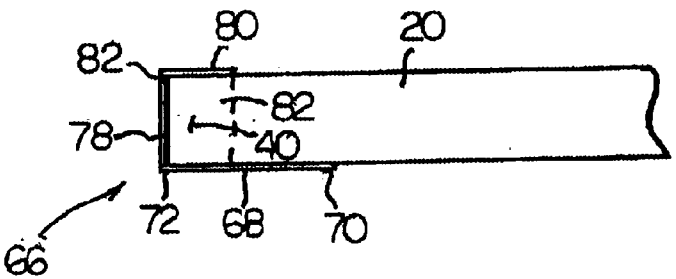
FIG. 3 is a cross section through A—A of FIG. 1.
Figure 5:
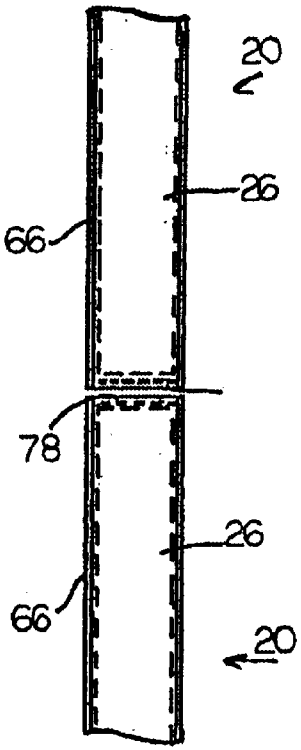
FIG. 5 is a side view of FIG. 4.

Referring to FIGS. 1 and 2 the counter weight door 10 also includes a first guide pulley 88 mounted adjacent the fist side 46 of the door, a first guide pulley mount 90 for mounting the first guide pulley 88 adjacent the first side of the door. A second guide pulley 92 is mounted adjacent the second side 48 of the door 10, and a second guide pulley mount 94 is provided for mounting the second guide pulley 92 adjacent said second side 48 of the door 10. A plurality of counter weights 96 are arranged adjacent the second side of the door 48 and provide a counter balancing force to the weight of the door. Connection means 97 are provided for connecting the plurality of counter weights 96 to each other and to the door 10.

Figure 12:
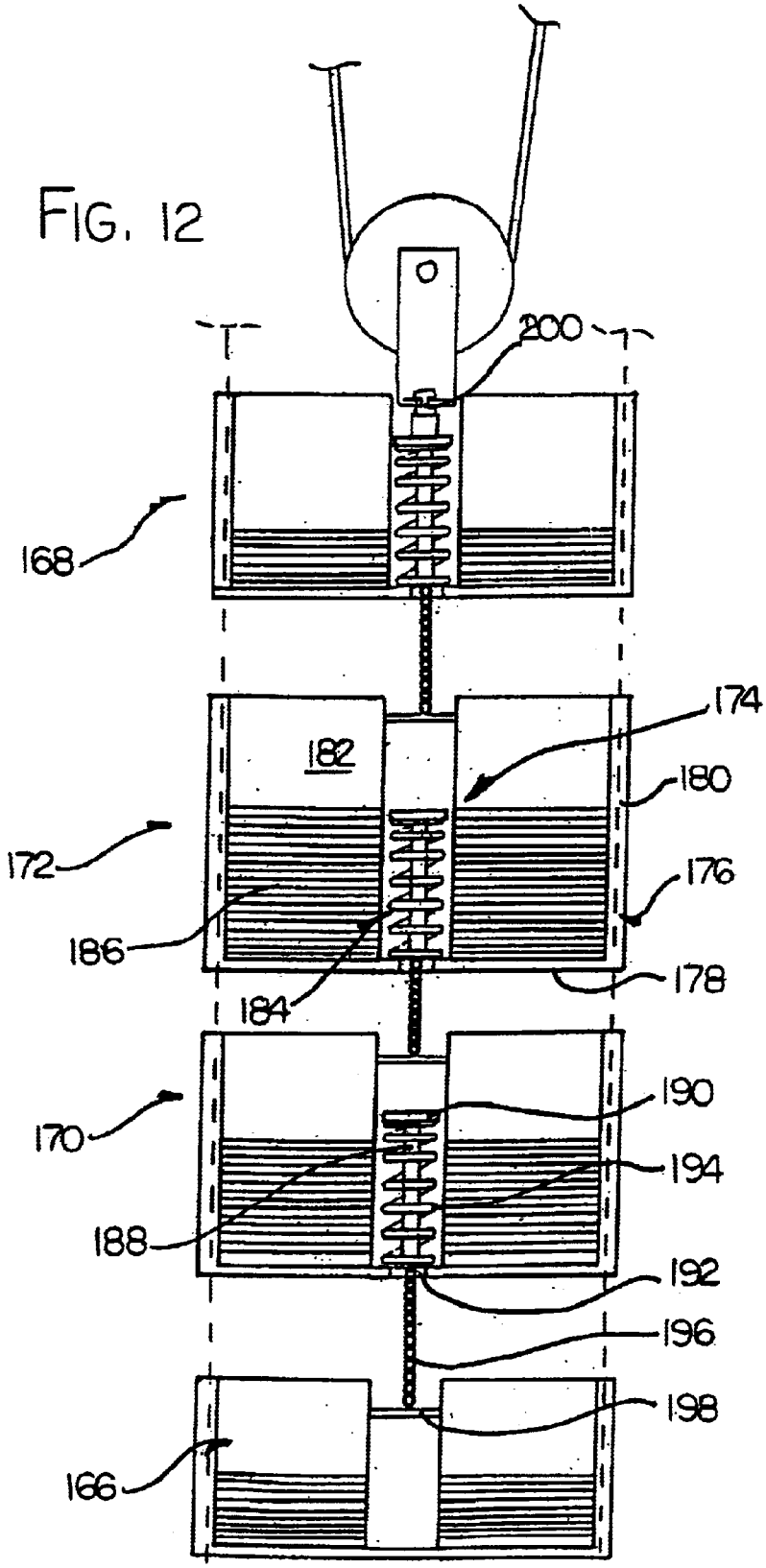
FIG. 12 is a front elevational view of the counter weight system.

As best shown in FIG. 12, the counter weights are aligned in a vertical manner such a first weight 166 is located at a bottom end of the connection means and a fourth weight 168 is located at a top end. A second counter weight 170 is located above the first counter weight and a third counter weight 172 is located above the second counter weight below the fourth counter weight. Each counter weight is vertically spaced from the respective counter weight and are connected by a spring biasing arrangement 174 therebetween. Each counter weight comprises a housing 176 having a bottom surface 178 and side walls 180 extending vertically therefrom. The housings are generally square in shape and have two sections 182 located on respective sides of an enclosure 184 at a centre portion of the housing between the side walls. Each section is arranged to receive an equal amount of plates 186 which enable the weight of each counter weight to be adjusted for specific arrangements. The amount of weight in each counter weight is relative to the type of door arrangement such as a standard lift type, a high lift type and a vertical lift type. The weight is measured to counter balance each section of the door and is different in certain applications.

The spring biasing arrangement between each counter weight comprises a vertically orientated shaft 188 which is located within the enclosure. The shaft has a horizontal flange 190 at its top end which allows movement of the shaft within the housing. A hole 192 at the bottom surface of housing directly below the shaft is arranged such that the shaft can move vertically therethrough. Situated on the shaft is a spring 194 which engages a bottom surface of the flange and a top surface of the bottom surface of the housing such that the spring forces the shaft upwards. At a bottom end of each shaft is a chain 196. The chain extends downwards from each shaft to a cross bar 198 which is located on the respective counter weight at a top end of the enclosure above the flange. The first weight does not have a spring biasing arrangement. The spring biasing arrangement allows smooth movement of the weights. The fourth weight is connected to the pulley by a swivel joint 200 which allows pivotal movement of the pulley without affecting the orientation of the weights. The swivel is coupled to the housing within the enclosure above the flange.

The first weight is associated with a top panel of the door, the fourth weight is associated with a bottom panel of the door and the second and third weights associated with the two remaining door panels accordingly. Thus providing each panel with independent counter weight for smooth operation of the door. Upwards movement, not shown, of the door lowers the weights such that the weights stack one on top of the other, defining an opening movement and position. Downwards movement of the door raises the weights such that each weight is vertically spaced from the next, defining a closing movement and position, as shown in FIG. 12.

First and second elongate members 98 and 100 are each fixed at a first end to the door 10 adjacent first and second sides thereof. The first elongate member 98 extends from the first side 46 of the door 10 over the first guide pulley 88 laterally across the door 10 and over the second guide pulley 90 to a second end 102. The second elongate member 100 extends from the second side 48 of the door 10 and over the second pulley 90 to a second end 104. The first and second elongate members 98 and 100 are connected to the connection means 97 adjacent the respective second ends 102 and 104 such that movement of the door 10 causes counter movement of the counter weights 96.

The door 10 when in the fully closed position lies in a plane extending substantially perpendicular to and between the substantially vertical guide rails 18*a* and 18*b*.

Referring to 2, 10, and 11 the first mounting plate 106 is fixed to an outer edge 108 of the first guide rail member 18*a* adjacent to curved portion 40 of the guide rail 18 and parallel to the vertical and horizontal portions 32 and 34 of the guide rail 18. The first mounting plate 106 extends forward the guide rail 18*a* towards the wall 14 of building.

Figure 6:
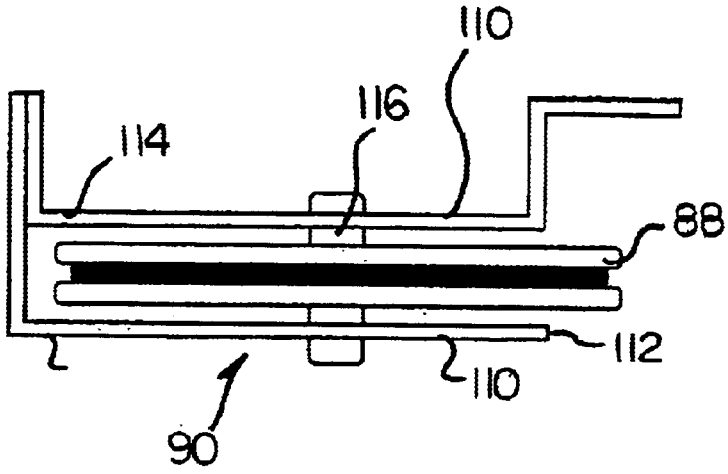
FIG. 6 is a side view of a part of the pulley system.
Figure 7:
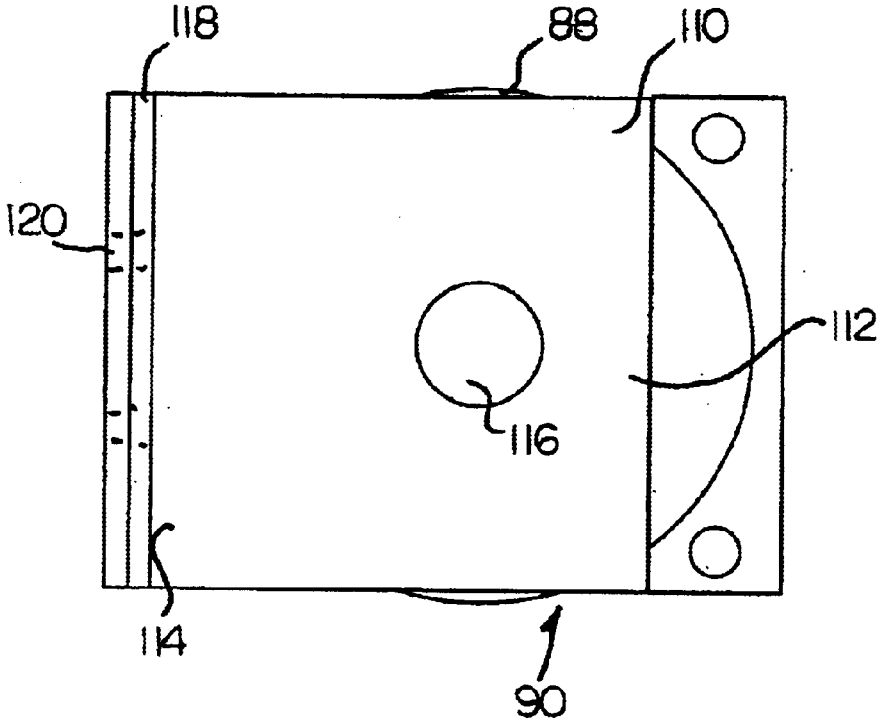
FIG. 7 is a side view of FIG. 6.
Figure 9:
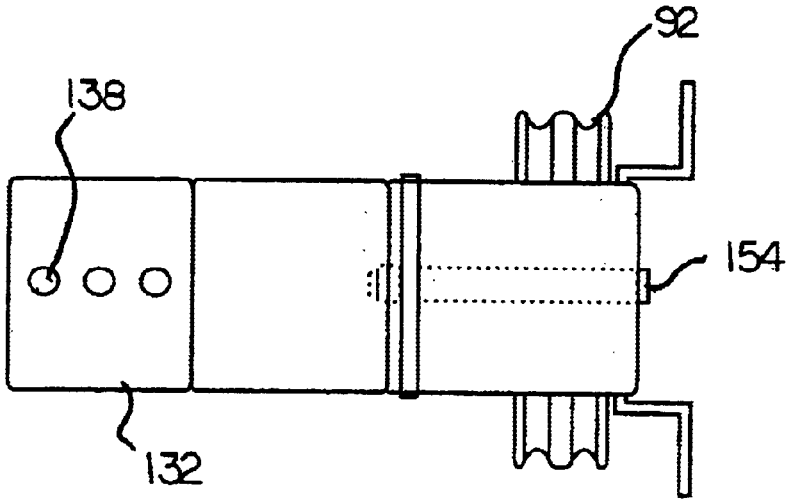
FIG. 9 is a bottom view of FIG. 8.

Referring to FIGS. 6, and 7 the first pulley mount 90 comprises a pair of parallel spaced apart plate members 110 extending from a first end 112 to a second end 114, an axle member 116 extending between the plate members 110, the pulley 88 arranged parallel to the plate members 110 and mounted on the axle 116, and an attachment plate 118 arranged perpendicular to the pair of parallel plates 110 and fixed to the first ends 112 thereof. The attachment plate 118 extends past one of the plate members 112 and includes a plurality of holes 120 arranged therethrough. The holes 120 in the first pulley mount 90 are arranged to co-operate with holes in the first mounting plate 106 to receive fasteners therethrough thereby fixing the first pulley mount 90 on the guide rail 18*a*.

Mounting the first pulley mount 90 on the guide rail 18*a* eliminates the need for mounting the pulley on the wall 14 of the building, and allows the pulley 89 to be more consistently and accurately aligned such that the cable 98 lies as close to the plane of the door 10 as possible.

Referring to 2, 8, 9, and 10 the door 10 also includes a mounting member 130 fixed to an outer edge of the second guide rail 18*b* adjacent to curved portion 40 of the guide rail member 18*b* and parallel to vertical and horizontal guide rails 32 and 34. The mounting member 130 extends forwards of the guide rail 18*b* towards the wall 14 of the building 16.

The second pulley mount 94 comprises a elongate attachment arm 132 which extends from a first end 134 to a second end 136 and has a plurality of holes 138 extending therethrough. The holes 138 are arranged along the attachment arm 132 to co-operate with holes arranged in the top of the mounting member 130. The holes 138 are arranged to receive fastener means 142 which fix the attachment arm to the guide rail 18*b*. The attachment arm 132 as it extends from the first end 134 to the second 136 angles forwards and upwards from a point 144 spaced rearwards from the second end 136. To a point 146 located nearer the second end 136.

A pair of parallel spaced apart members 148 and 149 each extending downwards from a first end 150 to a second end 152 or fixed to the attachment arm 132 at their first ends 150. The plate member 149 is fixed to the attachment arm 132 adjacent the second end 136 thereof. An axle member 154 extends between the plate members 148 and 149 and is arranged to lie parallel to the attachment arm 132. The second pulley 92 is mounted on the axle 154 perpendicular to the attachment arm 132 and such that it lies substantially in the plane of the door 10. The pulley 92 is a double pulley for receiving both the elongate members 98 and 100. The plate member 149 arranged at the end of the attachment arm 132 includes at least one hole 156 therethrough. The hole 156 is arranged for co-operation with the fastener means which fix the spaced apart plate member to the wall 14 of the building.

The second pulley mount 94 is mounted on the mounting member 130 securing it to guide rail 18 such that the second pulley 92 and the cable 100 lie as close to the plane of the door as possible.

The pulley mounts 90 and 94 allow the pulleys to be easily arranged and secured above and to the side of the opening 12 in the wall 14 and to lie in line with the substantially horizontal guide rails 18. Mounting the pulleys 88 and 92 directly on the guide rails helps the installer mount the pulleys such that their axis of rotation lies substantially perpendicular to the plane of the door 10. This helps ensure smooth operation of the pulleys 90 and 94 as the door 10 is opened and closed.

In an alternative arrangement the second pulley mount 94 may be mounted directly on the guide rail 18*b* securing it in line with the guide rail and allowing the second pulley 92 and the elongate cable 100 to lie as close to the plane of the door as possible. Further more the second pulley mount 94 may be fixed only to the guide rail or may be fixed to the guide wall and to the wall of the building to provide additional support.

While one embodiment of the present invention has been described in the foregoing, it is to be understood that other embodiments are possible within the scope of the invention. The invention is to be considered limited solely by the scope of the appended claims.

What is claimed is:

1. A counter weight door comprising:

two guides each arranged to be located on a respective sides of an opening on a building;

a door which is arranged to be supported on respective side thereon by the guides, the door having a plurality of panels each connected to the next one of the panels for common movement vertically in the guides;

a counter weight system coupled to the door for providing counter weight for the weight of the door, the counter weight system having a plurality of counter weights each associated with a respective one of the panels;

the counter weights being arranged vertically one above the next in a row;

an interconnecting coupling connecting each of the counter weights to the next and arranged such that a bottom surface of each of the counter weights is spaced from a top surface of the next when the weight of the door is supported by the counter weights and such that the bottom surface of each is stacked on top of the top surface the next so as to be supported by the next as the door is moved to a position so that is not required to be supported by the counter weights;

at least one of the counter weights comprising a base plate and side walls defining a cradle for receiving a plurality of individual weight members resting thereon such that the weight of said at least one counter weights can be adjusted by selecting a required number of the weight members.

2. The door according to claim 1 wherein each counter weight has a center support member with the base plate extending outwardly to each side of the center support member and arranged to receive on each side of the center support member a separate stack of the weight members.

3. The door according to claim 1 wherein each counter weight has a center support member in the form of a housing aligned with a center support member of the next counter weight and wherein the center support member houses a spring of the interconnecting coupling for connection to the next counter weight.

4. A counter weight door comprising:

two guides each arranged to be located on a respective side of an opening on a building;

a door which is arranged to be supported on respective side thereon by the guides, the door having a plurality of panels each connected to the next one of the panels for common movement vertically in the guides;

a counter weight system coupled to the door for providing counter weight for the weight of the door, the counter weight system having a plurality of counter weights each associated with a respective one of the panels;

the counter weights being arranged vertically one above the next in a row;

an interconnecting coupling connecting each of the counter weights to the next and arranged such that a bottom surface of each of the counter weights is spaced from a top surface of the next when the weight of the door is supported by the counter weights and such that the bottom surface of each is stacked on top of the top surface the next so as to be supported by the next as the door is moved to a position so that is not required to be supported by the counter weights;

the interconnecting coupling including a spring arrangement housed in one of the counter weights so as to allow the counter weights to be stacked one on top of the next.

5. The door according to claim 4 wherein the spring arrangement is mounted on a shaft located within the counter weight, the shaft being vertically orientated and having a horizontal flange at the top end, wherein the spring arrangement surrounds the shaft and engages the flange and a bottom surface of the counter weight such that the spring forces the shaft upwards, the shaft being connected to an elongate member which is coupled to a bottom end of the shaft and extends downwards therefrom to the next counter weight below.

6. A counter weight door comprising:

two guides each arranged to be located on a respective sides of an opening on a building;

a door which is arranged to be supported on respective side thereon by the guides, the door having a plurality of panels each connected to the next one of the panels for common movement vertically in the guides;

a counter weight system coupled to the door for movement of the door within the guide means having a plurality of counter weights;

an interconnecting coupling connecting the counter weights; and, a pulley system having;

a first guide pulley mounted adjacent a first side of the door;

a second guide pulley mounted adjacent a second side of the door;

a first elongate member fixed at a first end of the first elongate member to the door and extending through the first pulley;

a second elongate member fixed at a first end of the second elongate member to the door and extending through the second pulley;

wherein the second guide pulley has two pulley elements in a fixed rotatable relationship for receiving the first and second elongate members respectively, the first and second elongate members each extending through a third pulley at the counter weight system and each having a second end thereof anchored anchored to a fixed point.

7. The door according to claim 6, wherein there is a driveable member on the second guide pulley which is arranged to be driven by a motor such that the door is raised and lowered using a motor.

8. The door according to claim 7 wherein the driveable member is a sprocket arranged to receive a chain from the motor.

* * * * *